US007837381B2

(12) United States Patent
Damasko

(10) Patent No.: US 7,837,381 B2
(45) Date of Patent: Nov. 23, 2010

(54) MECHANICAL WINDING DEVICE FOR WRISTWATCHES AND WRISTWATCH FOR SUCH A WINDING DEVICE

(76) Inventor: Konrad Damasko, Unterheising 17c, D-93092 Barbing (DE)

( * ) Notice: Subject to any disclaimer, the term of this patent is extended or adjusted under 35 U.S.C. 154(b) by 5 days.

(21) Appl. No.: 12/155,248

(22) Filed: May 30, 2008

(65) Prior Publication Data

US 2008/0304371 A1 Dec. 11, 2008

(30) Foreign Application Priority Data

Jun. 1, 2007 (DE) ..... 10 2007 025 902
Sep. 28, 2007 (DE) ..... 10 2007 046 689

(51) Int. Cl.
*G04B 5/02* (2006.01)
*G04B 25/02* (2006.01)

(52) U.S. Cl. ..... 368/148; 368/208

(58) Field of Classification Search ..... 368/145, 368/147, 148, 150, 152, 206–208
See application file for complete search history.

(56) References Cited

U.S. PATENT DOCUMENTS

| | | | | |
|---|---|---|---|---|
| 3,306,025 | A * | 2/1967 | Kocher | 368/148 |
| 4,500,213 | A * | 2/1985 | Grimm | 368/208 |
| 6,021,098 | A * | 2/2000 | Rebeaud | 368/204 |
| 6,485,172 | B1 * | 11/2002 | Takahashi et al. | 368/148 |
| 7,287,901 | B1 * | 10/2007 | Helfer et al. | 368/147 |
| 7,347,618 | B2 * | 3/2008 | Mojon et al. | 368/208 |
| 7,547,136 | B2 * | 6/2009 | Bravo et al. | 368/152 |
| 2001/0005339 | A1 * | 6/2001 | Hara et al. | 368/208 |
| 2006/0239126 | A1 * | 10/2006 | Mojon et al. | 368/206 |

* cited by examiner

*Primary Examiner*—Vit W Miska
(74) *Attorney, Agent, or Firm*—Welsh Flaxman & Gitler LLC

(57) ABSTRACT

Automatic mechanical winding device for the driving spring of a mechanical clockwork of a wristwatch with an eccentric mass that can be swiveled on a joint, said mass having a center of mass that is radially offset from the axis of the joint, with gear means for converting the swivel or rotary motion of the eccentric mass into a motion that winds the driving spring.

18 Claims, 4 Drawing Sheets

FIG.1
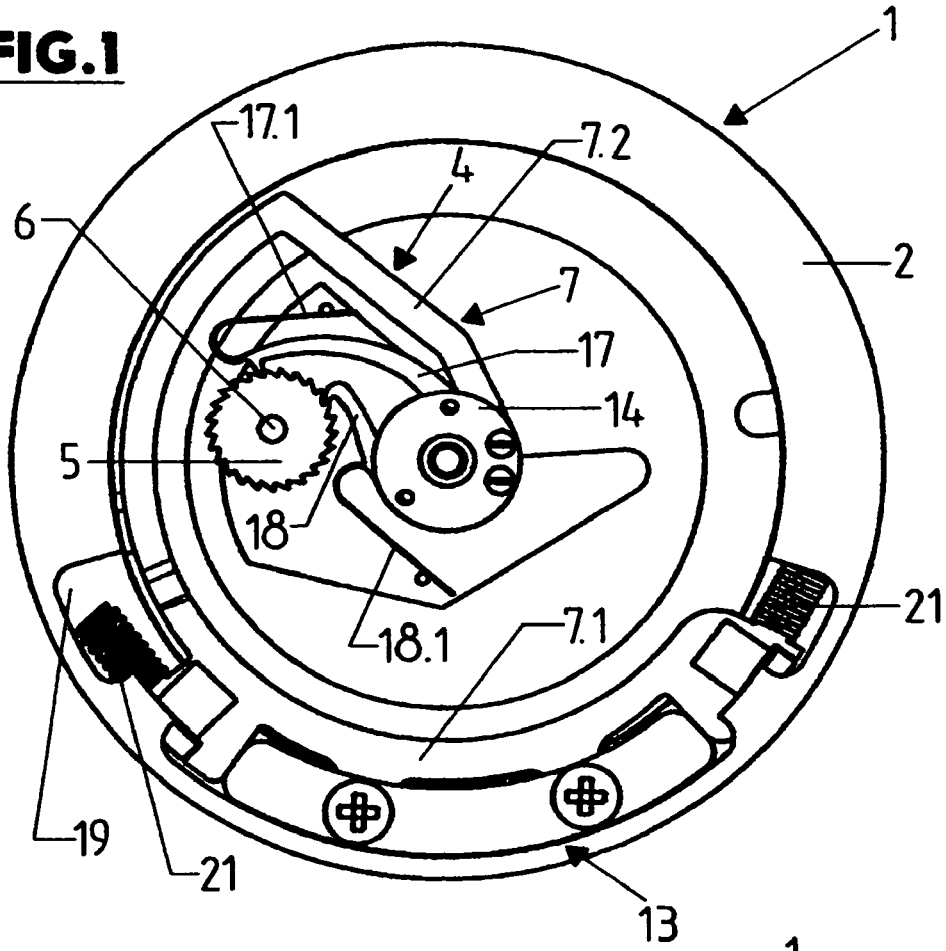
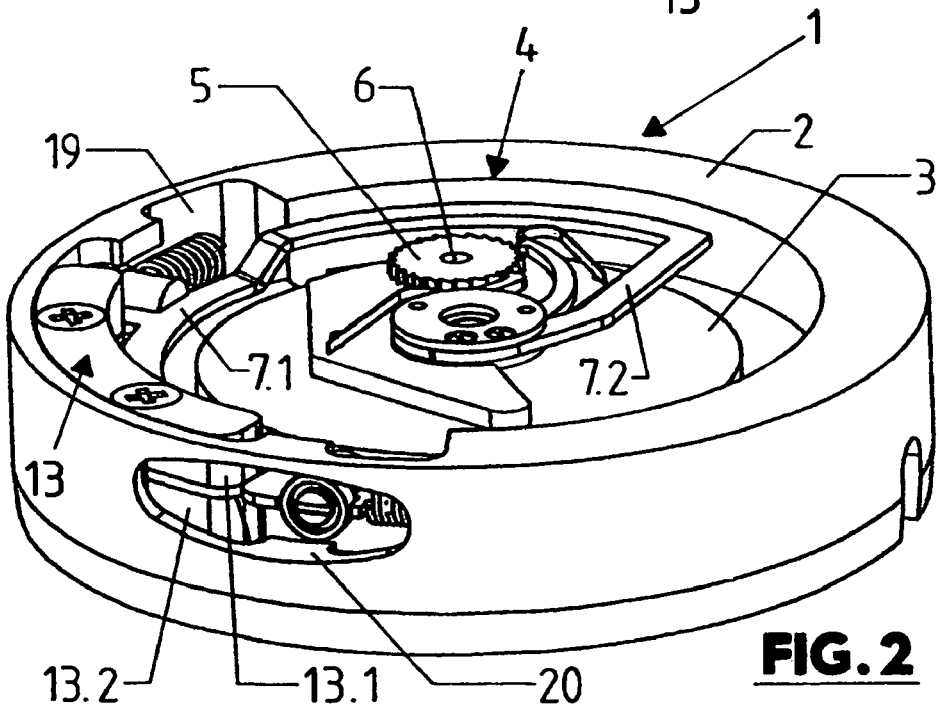
FIG.2

MECHANICAL WINDING DEVICE FOR WRISTWATCHES AND WRISTWATCH FOR SUCH A WINDING DEVICE

BACKGROUND OF THE INVENTION

The invention relates to a mechanical automatic winding device or spring winding device for the driving spring or watch spring of a mechanical clockwork of a wristwatch (automatic winding watch) and to a wristwatch with such a winding device.

Wristwatches with a mechanical clockwork and with an automatic winding device that winds the driving spring or watch spring when the wristwatch is moved are known in the art. The winding device in such watches generally consists of an unbalanced mass or eccentric mass that is located on the back of the clockwork and can be swiveled on a central clockwork axis, the swivel motion being converted by a gear array into a rotary motion that winds the clockwork spring.

A disadvantage of such mechanical automatic winding watches is that the shaft forming the swivel joint for the eccentric mass also serves to support this mass. In the event of jolts, vibrations or similar shock loads to the wristwatch, the forces occurring on the eccentric mass have to be absorbed by this shaft, which can easily result in damage to the watch.

Also known is the use of balls as the eccentric mass in mechanical winding devices for wristwatches, the balls being provided in a circular ball guide enclosing the clockwork, namely between fingerlike pushers that extend into the ball guide and are provided on a swivel arm, which is rotatably mounted on the clockwork on the same axis as the clockwork axis and the rotary motion of which is converted via a gear unit into a motion for winding the driving spring of the clockwork.

The disadvantage of this is that the ball guide for the balls forming the eccentric mass extends over an angle area of 360°, so that the space required for the ball guide results in a relatively high overall height and/or a relatively large diameter for the watch case.

It is an object of the invention is to present a mechanical automatic winding device for wristwatches (automatic winding watches) that eliminates the aforementioned disadvantages while featuring a high degree of operational reliability and enables a reduced size of the watch or the watch case.

SUMMARY OF THE INVENTION

The invention relates to an automatic mechanical winding device for the driving spring of a mechanical clockwork of a wristwatch with an eccentric mass that can be swiveled on a joint, the mass having a center of mass that is radially offset from the axis of the joint, with gear means for converting the swivel or rotating motion of the eccentric mass into a motion that winds the driving spring.

Further embodiments, advantages and possible applications of the invention are disclosed by the following description of exemplary embodiments and the drawings.

BRIEF DESCRIPTION OF THE DRAWINGS

The invention is described in more detail below based on exemplary embodiments as referred to in the drawings, wherein:

FIG. 1 is a simplified depiction of the back of a wristwatch with the back cover opened, together with the essential functional elements of the winding device;

FIG. 2 is a perspective view of the back of the wristwatch of FIG. 1, with the housing partially opened;

DETAILED DESCRIPTION OF THE INVENTION

Figure 3:
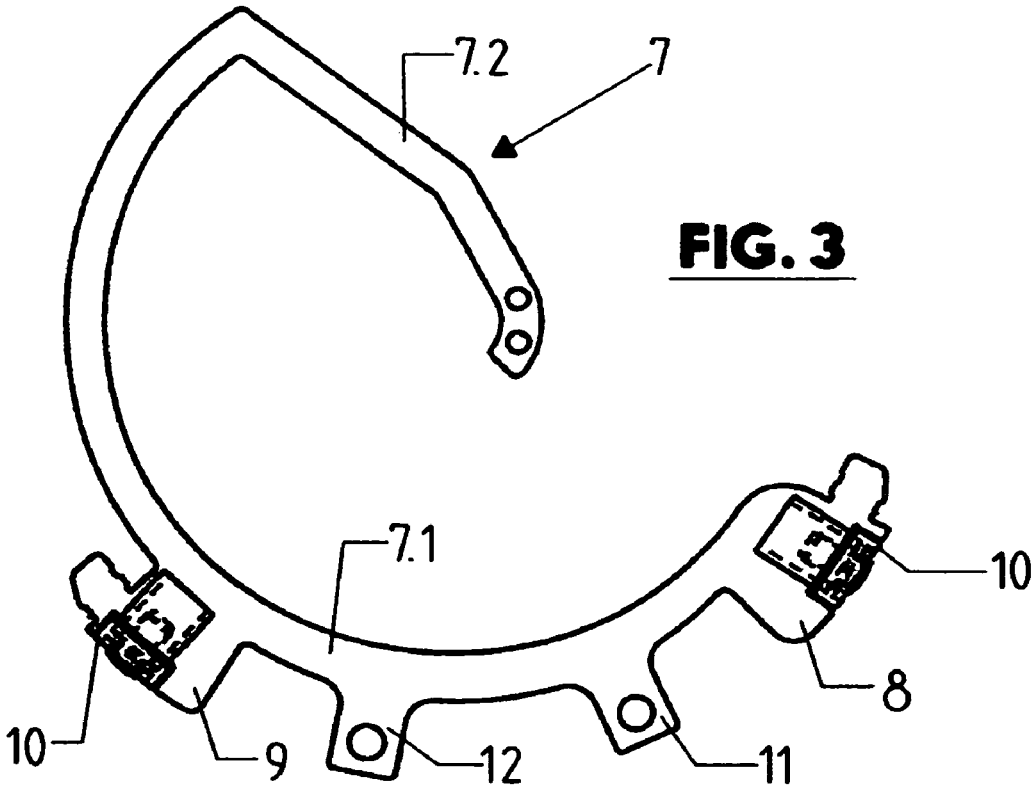
FIG. 3-4 are component drawings of a crescent-shaped swivel lever of the mechanical winding device of the wristwatch in FIGS. 1 and 2, manufactured from flat material.

In the drawings, 1 generally designates a wristwatch with the usual case 2, in which the mechanical clockwork 3 is accommodated, namely in the depicted embodiment symmetrically, i.e. in the manner that the axis of the set-hands arbor of the clockwork is on the same axis as the middle axis of the case 2. On the back of the clockwork 3 is the automatic mechanical winding device 4, which causes the spring of the clockwork 3 to wind when the wristwatch 1 is moved, namely by means of a ratchet wheel 5 connected with a spring housing not depicted in the drawings, which (ratchet wheel) is mounted on the spring housing and can rotate on an axis 6 parallel to the clockwork axis or to the axis of the set-hands arbor of the clockwork 3.

Figure 4:
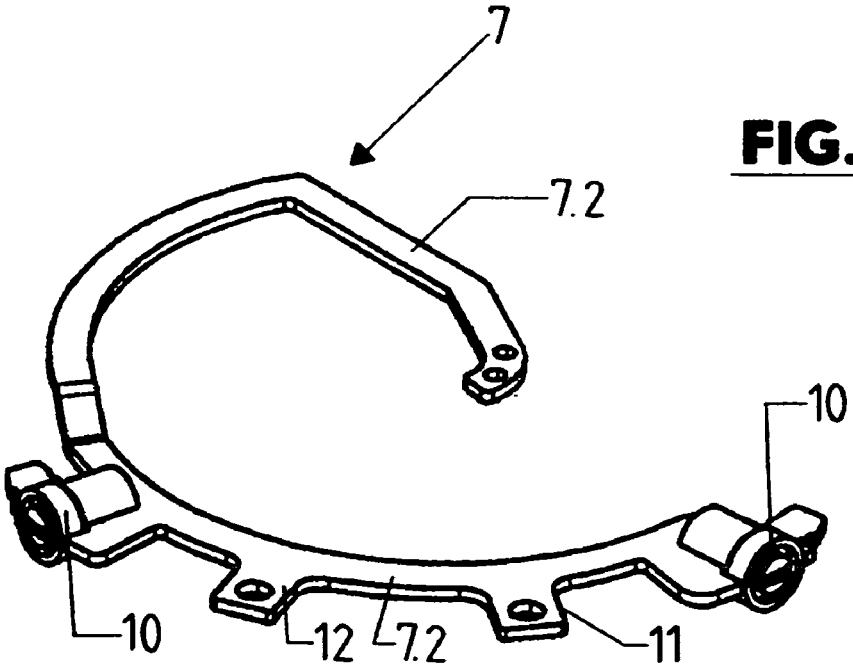

The winding device 4 comprises in addition to the ratchet wheel 5 a crescent-shaped swivel lever 7, which is manufactured form a suitable flat metal material, namely with a circular arc lever section 7.1, which is curved on an axis parallel to the axis of the set-hands arbors, and with a lever section 7.2 extending radially to the curvature axis and in the depicted embodiment bent several times, extending radially inward from the section 7.1 (see also FIGS. 3 and 4). The section 7.1 is provided on a partial section starting form the end located distant from the section 7.2 with two projections 8 and 9, of which the projection 8 is provided on the free end of the section 7.1 and the projection 9 is provided at a distance from the free end of the section 7.1. Each of the two projections 8 and 9 is provided with a slide or guide element 10, e.g. in the form of a sliding element or roller, which is mounted to freely rotate by means of a ball bearing on an axis radial to the curvature axis of the section 7.1 or radial to the middle axis of the clockwork 3 or to the axis of the set-hands arbors of the clockwork. Between the two projections 8 and 9, above the convex side of the section 7.1 facing away from the section 7.2, two further projections 11 and 12 are provided, on which a circular arc mass weight 13 is fastened. The mass weight 13 consists of two circular segment curve single weights 13.1 and 13.2, which are manufactured identically from a metal material with a high specific density, i.e. with a density greater than 14 g/cm$^3$, for example of gold or platinum, and fastened on both sides on the partial section of the lever 7 formed between the projections 8 and 9 with screws extending through holes in the projections 11 and 12.

The lever 7 is fastened with the free end of the section 7.2 to a disk 14, which itself is mounted on bearings so that it can rotate or swivel on a journal 15 on an axis parallel to the clockwork axis or parallel to the axis of the set-hands arbors on a bottom plate 16 of the clockwork 3, namely for a back and forth rotary or swivel motion of the lever 7, as indicated in FIG. 1 by the double arrow A.

Two pawl levers 17 and 18 that engage with the ratchet wheel 5 are mounted on the disk 14, each pawl lever being manufactured with a formed-on leaf spring, for example by laser cutting from a suitable flat metal material and engaging through these springs with their free blade- or pawl-shaped ends with the gear teeth of the ratchet wheel 5. The pawl levers are hinged on the disk 14 on different sides of an imaginary connecting line between the axis 6 of the ratchet wheel and the axis of the journal 15, so that when the lever 7 is swiveled on the axis of the journal 15, the ratchet wheel 5 is turned alternately via the two levers 17 and 18, therefore winding the clockwork 3. As a result of the use of two pawl levers 17 and 18 and of the described array of these levers or their hinge points on the disk 14, a motion of the ratchet wheel 5 that winds the spring of the clockwork 3 takes place in each phase of the swivel motion of the ratchet wheel 5, i.e. both during clockwise swiveling of the lever 7 and counterclockwise swiveling of the lever 7, advantageously by a pulling force exerted via the pawl lever 17 or 18.

A recess is formed in the case 2 for accommodation of the two-part mass weight 13. The recess 19 is larger than the length of the mass weight, so that a swivel motion of the mass weight 13 and therefore of the lever 7 on the axis of the journal 15 is possible, namely for example over a maximum path of 1.5-3 mm, for example a maximum path of 2.5 mm and preferably 1.5 mm. To support the mass weight 13, the two slide or guide elements 10 that are offset in relation to the ends of the mass weight 13 are guided in guides 20 formed in the case 2.

To prevent noise during swiveling of the mass weight 13, absorbing springs 21 are provided on the projections 8 and 9, which (springs) engage with stop or limiting surfaces in the recess 19.

Figure 5:
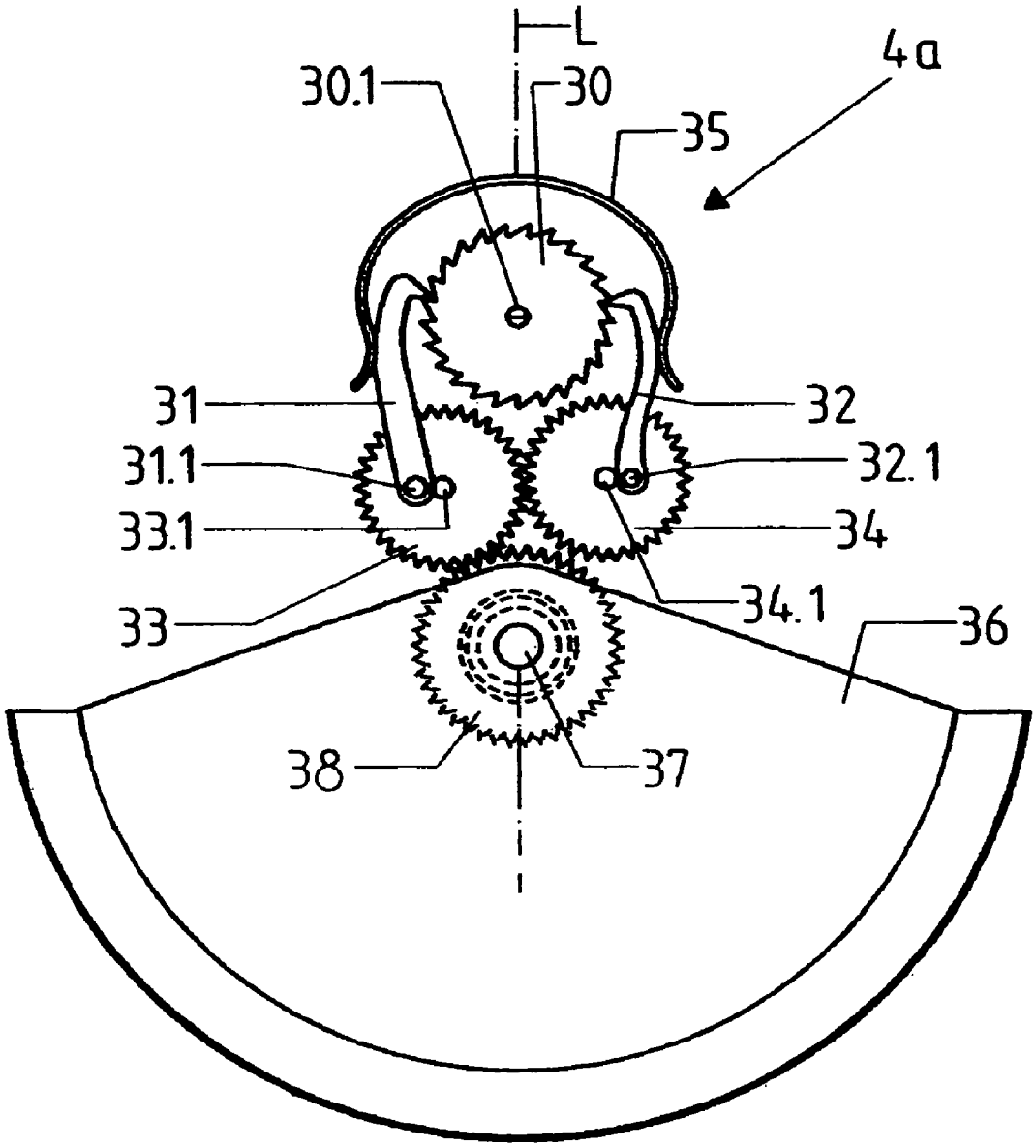
FIG. 5-6 are schematic representations of further mechanical winding devices according to the invention.

FIG. 5 shows a simplified view of a further embodiment of an automatic mechanical winding device 4*a* of a clockwork for a wristwatch, which (winding device) winds the spring of the clockwork when the wristwatch is moved, namely via a ratchet wheel 30, which is provided on the spring housing of the clockwork. Two pawl levers 31 and 32 engage with this ratchet wheel, which (pawl levers) are hinged eccentrically on a gear 33 and 34 at 31.1 and 32.1, respectively, namely so that they can swivel on axes parallel to the axis 30.1 of the ratchet wheel 30 and parallel to the axis 33.1 and 34.1 of the respective gear 33 and 34. Due to spring means, which in the depicted embodiment consist of a bow spring 35, the free ends of the pawl levers 31 and 32 engage spring-controlled with the gears of the ratchet wheel 30. Further, the two gears 32 and 34 are connected with each other in a driven manner via their gear teeth.

The gearwheel 33 comprising the pawl lever 31 is connected in a driven manner with an eccentric or mass weight or rotor 36, which is mounted so that it can swivel on an axis 37 parallel to the clockwork axis or parallel to the axis of the set-hands arbors of the clockwork and in the depicted embodiment comprises a gearwheel 38 that engages with a gearwheel 33, so that swiveling of the mass weight 36 on the axis of the shaft 37 via the gearwheel 38 produces a back and forth or swivel motion of the gearwheels 33 and 34 on their axes 33.1 and 34.1, resulting in a rotation of the ratchet wheel 30 via the pawl levers 31 and 32 and therefore winding of the spring of the clockwork in each phase of this swivel motion, i.e. both during clockwise and counterclockwise swiveling.

To achieve this, the winding device 4*a* is designed with gearwheels 33 and 34 of the same size and the gearwheels and the pawl levers 31 and 32 are arranged mirror symmetrically to an imaginary line L, which intersects the axes of the ratchet wheel 30 and also the axis of the shaft 37. Further, in the initial position of the mass weight 36, the hinge points of the pawl levers 31 and 32 are provided on the corresponding gearwheels 33 and 34 on the side of the axis 33.1 and 34.2 of the corresponding gearwheel 33 and 34 facing away from the line L and the free ends of the ratchet wheels 31 and 32 engage in the teeth of the ratchet wheel 30 on two diametrically opposing sides of the ratchet wheel 30 in relation to the line L. Further, in this embodiment, the pawl lever 31 or its end engaging with the ratchet wheel 30 exerts a pulling force on the ratchet wheel 30 to turn this wheel and, inversely, the pawl lever 32 exerts a pushing force with its end on the ratchet wheel 30 to turn this wheel.

Figure 6:
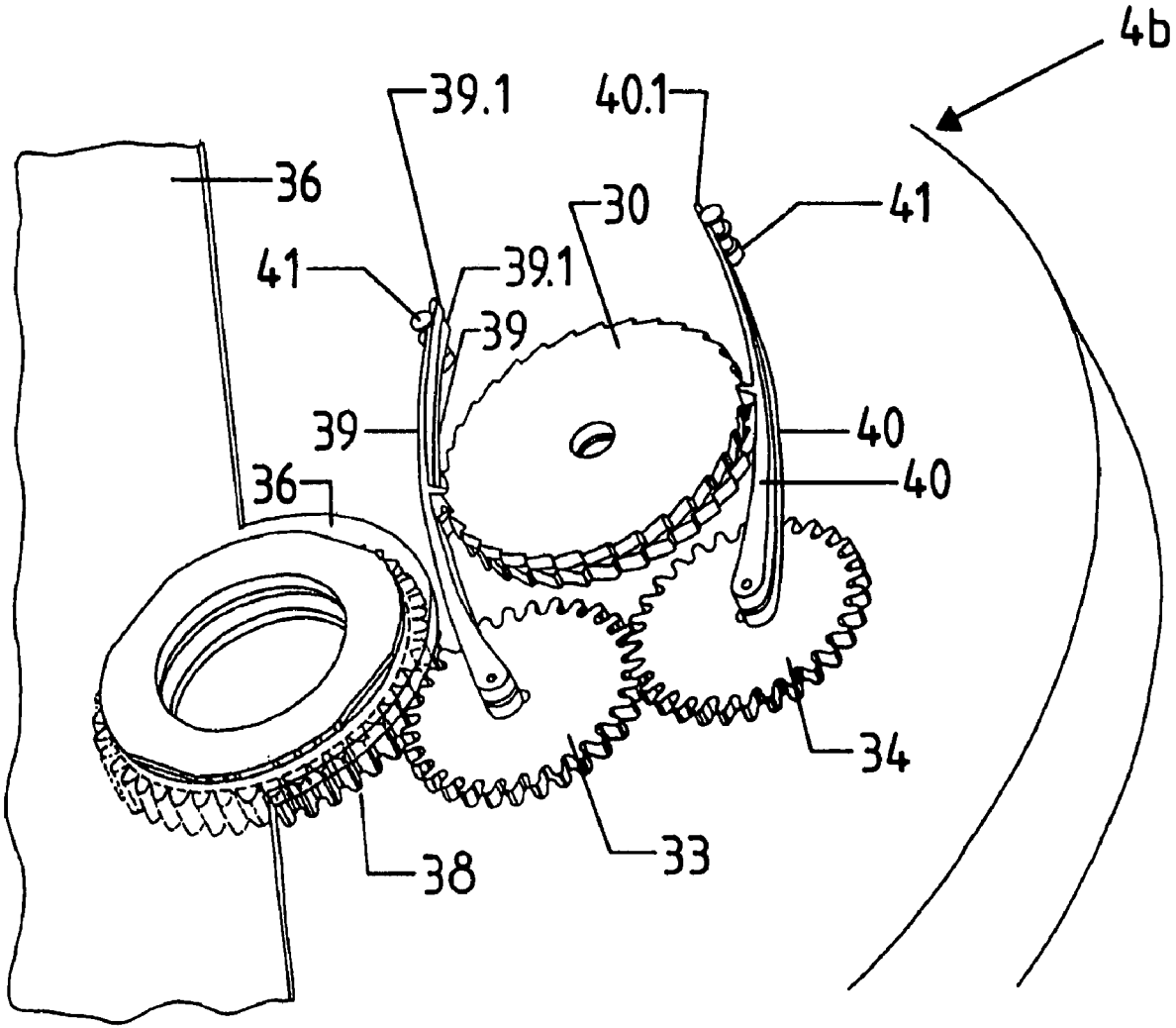

FIG. 6 shows a very schematic view of a further embodiment of an automatic mechanical winding device 4*b* of a clockwork for a wristwatch, which (winding device) winds the spring of the clockwork when the wristwatch is moved and which largely corresponds to the winding device 4*a* with respect to its function and design. For this reason, elements in FIG. 6 that correspond to the elements of the winding device 4*a* are designated with the same reference numbers as in FIG. 4*a*.

The winding device 4*b* differs from the winding device 4*a* initially in that instead of the pawl lever 31 and 32, pawl lever pairs or pawl lever arrays, respectively consisting of two pawl levers 39 and 40 are provided, which have a leaf spring or bow spring effect and which are hinged respectively on an end at 39.1 and 40.1 on the gearwheel 33 and 34 and are supported with their other end on guides 41 provided on the base plate. A further difference from the winding device 4*a* is that instead of only one single ratchet wheel 30, two such wheels 30 are provide one above the other on the same axis, namely with differing orientations of their ratchet teeth. On each pawl lever 39 and 40 a pawl is provided so that the pawl engages on a pawl lever 39 and 40 with the a ratchet wheel 30 and the pawl on the other pawl lever 39 and 40 engages with the other ratchet wheel 30 due to the spring effect of the respective pawl lever, so that each swivel motion of the mass weight 36 contributes to a rotary motion of the shaft comprising the ratchet wheels 30 and therefore winds the spring of the clockwork.

The invention was described above based on exemplary embodiments. It goes without saying that numerous modifications and variations are possible without abandoning the underlying inventive idea on which the invention is based.

For example, it is possible to use, instead of the circular segment mass weight 36, another mass weight, for example the mass weight 13 provided on the lever 7, in which case then the lever 7 is mounted with the free end of its lever section 7.2 on the gearwheel 38 so that it can swivel or rotate on the shaft 37.

REFERENCE LIST

1 wristwatch
2 case
3 clockwork
4, 4*a*, 4*b* winding device
5 ratchet wheel
6 rotary axis of the ratchet wheel
7 lever
7.1, 7.2 lever section
8, 9 projection
10 roller
11, 12 projection
13 mass weight
13.1, 13.2 weight element
14 disk
15 pivot
16 bottom plate
17, 18 pawl
17.1, 18.1 formed on bow spring
19 recess
20 guide
21 absorbing spring
30 ratchet wheel

30.1 axis of the ratchet wheel
31, 32 pawl lever
31.1, 31.2 link point of the pawl lever
33, 34 gear
33.1, 34.1 gear axis
35 bow spring
36 mass weight
37 shaft
38 gear on mass weight 36
39, 40 pawl lever
39.1, 40.1 end of pawl lever
41 guides
L line

What is claimed is:

1. An automatic mechanical winding device for the driving spring of a mechanical clockwork of a wristwatch, with an eccentric mass that can be swiveled on a joint, said mass having a center of mass that is radially offset from the axis of the joint, with gear means for converting the swivel or rotary motion of the eccentric mass into a motion that winds the driving spring, wherein the near means comprises at least one double-acting pawl array, the at least one double-acting pawl array comprises:

at least one ratchet wheel, at least two pawl lever supports connected in a driven manner with each other for a contradirectional rotary or swivel motion, and at least two pawl levers engaging with the ratchet wheel, said at least two pawl lever supports swiveled on an axis by the eccentric mass, at least one pawl lever engaging with the ratchet wheel is hinged on one of the pawl lever supports radially offset from the swivel axis of the pawl lever support so that the pawl lever engaging with the ratchet wheel causes said wheel to turn upon the swiveled or rotary motion of the eccentric mass.

2. The winding device according to claim 1, wherein the eccentric mass comprises at least one bow or lever and at least one mass weight on said lever or bow, that at least one guide element guided in a guide of the case is on the eccentric mass or on a part of the lever supporting said mass, and that the lever is connected with the gear means.

3. The winding device according to claim 2, wherein the at least one guide element consists of at least one slide element.

4. The winding device according to claim 2, wherein the at least one guide element consists of at least one freely rotatable mounted roller, or a roller mounted on ball bearings.

5. The winding device according to claim 3, wherein the slide element and a surface engaging with said element is surface treated or coated in order to minimize friction.

6. The winding device according to claim 1, wherein the pawl levers or their bearing point are provided on opposite sides of a respective connecting line (L) between a swivel axis of the pawl lever support and a rotary axis of the at least one ratchet wheel.

7. The winding device according to claim 1, wherein the at least two pawl levers can swivel on a common pawl lever support, consisting of a disk.

8. The winding device according to claim 1, wherein the pawl lever supports consist of two gearwheels that engage with each other.

9. The winding device according to claim 8, wherein one of the two pawl lever supports is connected in a driven manner with the eccentric masse.

10. The winding device according to claim 8 wherein in the case of the pawl lever support being embodied as a gearwheel, the eccentric mass is connected with the pawl lever supports in a driven manner via a gear or a gearwheel.

11. The winding device according to claim 1, wherein the pawl lever supports are provided with formed on springs.

12. The winding device according to claim 1, wherein the at least one pawl lever is a leaf spring or bow spring.

13. The winding device according to claim 1, wherein the at least one pawl lever is a bow spring to engage with the at least one ratchet wheel.

14. The winding device according to claim 1, wherein the at least two pawl levers form a pawl lever array with at least two pawls, each of which engages with a ratchet wheel, and that the ratchet wheels differ from each other in the design or orientation of their gear teeth.

15. A wristwatch comprising a winding device according to claim 1.

16. An automatic mechanical winding device for a driving spring of a mechanical clockwork of a wristwatch with an eccentric mass that can be swiveled on a joint, said mass having a center of mass that is radially offset from the axis of the joint, with gear means with at least one double-acting pawl array for converting the swiveled or rotary motion of the eccentric mass into a motion that winds the driving spring, said pawl array comprises at least two ratchet wheels and at least one pawl lever provided eccentrically on at least one pawl lever support which is swiveled on an axis by the eccentric mass, the at least one pawl lever comprising two pawls, each of which engages with one of the ratchet wheel, with the ratchet wheels differ from each other in the design or orientation of their gear teeth.

17. The winding device according to claim 16 wherein the at least two ratchet wheels are on a common shaft and are offset from each other in the axis direction of said shaft.

18. The winding device of claim 16, wherein the pawl array comprises at least two pawl lever supports connected in a driven manner with each other for a contra-directional rotary or swivel motion on a swivel axis of the pawl lever support by the eccentric mass, and at least two pawl levers that are hinged each on one of the pawl lever supports radially offset from the swivel axis of the pawl lever support.

* * * * *